United States Patent [19]

Fujii

[11] Patent Number: 4,820,186

[45] Date of Patent: Apr. 11, 1989

[54] IC CARD CONNECTOR

[75] Inventor: Noriaki Fujii, Itami, Japan

[73] Assignee: Mitsubishi Denki Kabushiki Kaisha, Japan

[21] Appl. No.: 171,901

[22] Filed: Mar. 22, 1988

[30] Foreign Application Priority Data

Mar. 31, 1987 [JP] Japan ..... 62-79915

[51] Int. Cl.[4] ..... H01R 13/04

[52] U.S. Cl. ..... 439/326

[58] Field of Search ..... 439/312, 326–328, 439/629–637

[56] References Cited

U.S. PATENT DOCUMENTS 4,128,289 12/1978 Occhipinti ..... 439/326

*Primary Examiner*—Joseph H. McGlynn

*Attorney, Agent, or Firm*—Leydig, Voit & Mayer

[57] ABSTRACT

An IC card connector is provided which comprises a fixed frame, electrode pieces attached to the fixed frame so as to form contact portions, a moving frame having a holding portion in which the IC card is inserted and held and a window from which each of the electrode terminals of the IC card is exposed when the IC card is inserted into the holding portion, and a support mechanism for supporting the moving frame on the fixed frame. The support mechanism acts to allow the moving frame to rotate between a first position, at which each of the electrode terminals of the IC card inserted into the holding portion of the moving frame is brought into contact with the contact portions of each of the electrode pieces through the window of the moving frame, and a second position, at which the contact between each of the electrode terminals and the contact portion of each of the electrode pieces is broken by the rotation of the moving frame to a position which is at a certain angle with respect to the fixed frame.

11 Claims, 2 Drawing Sheets

IC CARD CONNECTOR

BACKGROUND OF THE INVENTION

1. Field of the Invention

The present invention relates to an IC card connector which brings the electrode terminals of an IC card that is inserted into the connector securely into contact with electrode pieces thereof.

2. Description of the Related Art

A conventional IC card connector for connecting an IC card has such a structure as shown in the sectional view of FIG. 5 which shows the state before the IC card is inserted.

A frame 1 made of an insulating material such as a synthetic resin is provided on an external device (not shown) such as a card reader. A plurality of electrode pieces 2 each comprising a resilient conductor such as a metal are fixed to the frame 1 and are bent at their ends to form contact portions 2*a*. A moving body 3 is supported in the frame 1 so as to be able to slide in the longitudinal direction of FIG. 5, and a projection 3*a* extending downwardly is provided on the lower surface of the moving body 3. A lever 4 is rotatably provided in a lower portion of the frame 1 by means of a support pin 5 so that the moving body 3 is pushed upwardly by the projection 3*a* when the lever 4 rotates in the counterclockwise direction A as shown in FIG. 5.

An IC card 8 is inserted into this connector. A plurality of electrode terminals 9 are provided along one surface of the IC card 8. The lever 4 of the connector is initially rotated in the counterclockwise direction A so as to upwardly push the moving body 3. In this state, the contact portion 2*a* of each of the electrode pieces 2 is pushed to the left as viewed in FIG. 5 to be opened by an electrode operating portion 3*b* which projects from the lower side of the moving body 3.

When the IC card 8 is inserted into the connector, the lower end of the IC card 8 is brought into contact with the electrode operating portion 3*b* of the moving body 3 so as to push the moving body 3 downward, and the contact portion 2*a* of each of the electrode pieces 2 is released from the state wherein it is pushed open so as to elastically return to a closed position wherein it is brought into contact with each of the electrode terminals 9 of the IC card 8 as shown in FIG. 6. At the same time, the lever 4 is rotated in the clockwise direction by the downward movement of the projection 3*a* of the moving body 3.

When the IC card 8 is extracted from the connector, the lever 4 is rotated in the counterclockwise direction A so as to move the moving body 3 upward. As a result, the electrode operating portion 3*b* of the moving body 3 pushes the ends of the electrode pieces 2 so as to make the contact portions 2*a* open as well as upwardly pushing on the IC card 8. In this way, the connector is returned to the state shown in FIG. 5 so that the IC card 8 is extracted from the connector.

As described above, by inserting slidably the IC card 8 into the conventional IC card connector, the electrical contact between the contact portions 2*a* of the electrode pieces 2 which are provided on the frame 1 and the electrode terminals 9 of the IC card 8 is provided only on the basis of the elastic forces of the electrode pieces 2. This involves the consequent danger that the elastic forces of the electrode pieces will decrease as the connector is used more and more, and that, when the thickness of the IC card 8 is smaller than a given value, electrical contact therebetween cannot be obtained adequately, resulting in an imperfect contact.

A further danger is that, when the thickness of the IC card 8 is large, the package of the IC card 8 will be brought into contact with the contact portions 2*a* of the electrode pieces 2 and thus wear out when the IC card is linearly inserted into or extracted from the connector, resulting in an imperfect contact due to the adhesion of the powder produced by the wear to the contact portions 2*a* and in the exposure of the electrical parts in the IC card 8 that are protected by the package.

SUMMARY OF THE INVENTION

The present invention has been achieved with a view to solving the above-described problems, and it is an object of the present invention to provide an IC card connector with which an IC card can be securely brought into electrical contact, and which does not cause wear of a package even if the thickness of the IC card is considerable.

An IC card connector to which the present invention relates is a connector which can hold an IC card and provide electrical contact with each of the electrode terminals of the IC card, and comprises:

a fixed frame;

electrode pieces which are attached to the fixed frame and project in the fixed frame so as to form contact portions;

a moving frame having a holding portion in which the IC card can be inserted and held and a window from which each of the electrode terminals of the IC card is exposed for contact with said electrode pieces when the IC card is inserted into the holding portion; and a support means for supporting the moving frame on the fixed frame so that the moving frame can be rotated between a first position, at which each of the electrode terminals of the IC card inserted into the holding portion of the moving frame is brought into contact with the contact portion of each of the electrode pieces through the window, and a second position, at which the contact between each of the electrode terminals and the contact portion of each of the electrode pieces is canceled by the rotation of the moving frame at a certain angle with respect to the fixed frame, the support means being operable to hold the moving frame at the first position when the moving frame is rotated to take the first position.

In other words, in the present invention, each of the electrode terminals of the IC card is brought into contact with the contact portion of each of the electrode pieces of the connector by rotating the moving frame in which the IC card is inserted into the holding portion.

DESCRIPTION OF THE PREFERRED EMBODIMENT

Figure 1:
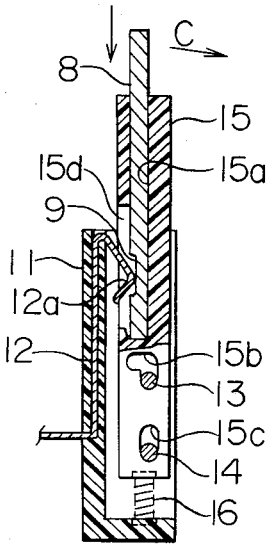
FIG. 1 is a sectional side view of an IC card connector according to an embodiment of the present invention in a closed state.
Figure 2:
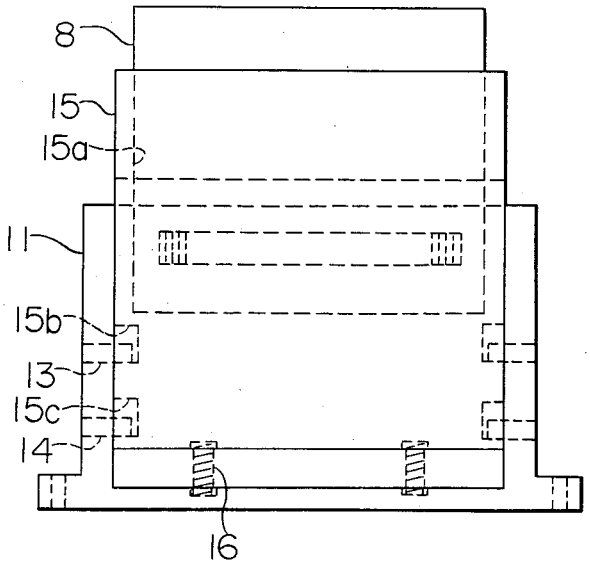
FIG. 2 is a front view of the IC card connector shown in FIG. 1.

In FIGS. 1 and 2, a fixed frame 11 made of an insulating material such as a synthetic resin is provided on an external device (not shown ) such as a card reader. A plurality of electrode pieces 12 each comprising a resilient conductor such as a metal are fixed to the fixed frame 11 and are projected and bent at their ends in the fixed frame 11 to form angular contact portions 12*a*. First and second support pins 13 and 14 are fixed at a given distance from each other in the longitudinal direction on each of the side walls of the fixed frame 11 so as to project outwardly of the fixed frame 11.

A moving frame 15 made of an insulating material such as a synthetic resin is pivotally mounted on the fixed frame 11. The moving frame 15 has a concave formed holding portion 15*a* formed therein in which an IC card is inserted so as to be held in position. A hooked or L-shaped hole 15*b* and an elongated hole 15*c* are formed in each of the side walls of the moving frame 15. The hooked hole 15*b* engages the first support pin 13 of the fixed frame 11 and comprises a lateral portion and a vertical portion. The elongated hole 15*c* engages the second support pin 14 and extends longitudinally of the moving frame.

Figure 3:
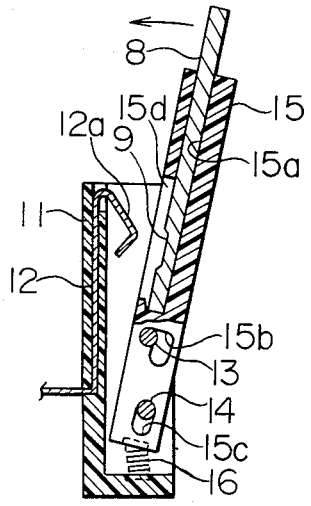
FIG. 3 is a sectional side view of the IC card connector shown in FIG. 1 in a state wherein the contact is opened.

The moving frame 15 is supported by the fixed frame 11 through the engagement of the first and second support pins 13 and 14 with the hooked holes 15*b* and the elongated holes 15*c*, respectively, so that it can slide a given length in the longitudinal direction. Further, when the moving frame 15 is slid down as far as possible with respect to the fixed frame 11, it becomes possible to swing the upper end of the moving frame 15 away from the fixed frame 11 to a certain angle due to the engagement of the lateral portions of the hooked holes 15*b* with the first pins 13, as shown in FIG. 3.

A window 15*d* opened at the position facing the contact portions 12*a* of the electrode pieces 12 is formed in the holding portion 15*a* of the moving frame 15.

In addition, a plurality of compression springs 16 are interposed between the bottom of the fixed frame 11 and the lower end of the moving frame 15 and act on the moving frame 15 as a biasing force that tends to push the moving frame 15 upwards.

When an IC card 8 is mounted in the connector which is configured as described above, the IC card is firstly inserted into the holding portion 15*a* of the moving frame 15 in the state (second position) wherein the first support pins 13 are engaged with the lateral portions of the hooked holes 15*b* so that the upper end of the moving frame 15 is separated outwardly (to the right as viewed in FIG. 3) from the fixed frame 11 by a certain angle. Accordingly, when the IC card 8 is inserted, the package of the IC card 8 does not wear due to the contact between the contact portions 12*a* of the connector and portions near the electrode terminals 9 of the IC card 8. At this time, the IC card 8 is inserted into the connector so that the electrode terminals 9 face the window 15*d* of the holding portion 15*a*.

The moving frame 15 is then rotated together with the IC card 8 so that the upper end of the moving frame 15 is brought near the fixed frame 11 (to the left as viewed in FIG. 3), and the moving frame 15 is placed at the first position at which the electrode terminals 9 of the IC card 8 are brought into contact with the fronts of the contact portions 12*a* through the window 15*d*.

At the same time, the first support pins 13 are disengaged from the lateral portions of the hooked holes 15*b* so that the moving frame 15 is slid upward by the compression springs 16 to assume the state shown in FIG. 1. Namely, the first support pins 13 are engaged with the vertical portions of the hooked holes 15*b* so as to inhibit the rotation of the moving frame 15 and to hold the contact state between the electrode terminals 9 of the IC card 8 and the contact portions 12*a* of the electrode pieces 12.

On the other hand, when the IC card 8 is extracted from the connector, the IC card 8 is pushed downward together with the moving frame 15 in the state shown in FIG. 1 so that the upper ends of the hooked holes 15*b* are brought into contact with the upper surfaces of the first support pins 13 and the upper ends of the elongated holes 15*c* are brought into contact with the upper surfaces of the second support pins 14. The IC card 8 and the moving frame 15 are then rotated in the clockwise direction C shown in FIG. 1 around the second support pins 14, which act as fulcrums, to allow the moving frame 15 to pivot to the second position which is at a certain angle with respect to the fixed frame so that the first support pins 13 are engaged with the lateral portions of the hooked holes 15*b*. This state is maintained by the upwardly urging forces of the compression springs 16.

Accordingly, as shown in FIG. 3, the electrode terminals 9 of the IC card 8 are separated from the contact portions 12*a*, and the IC card 8 is extracted. Therefore, when the IC card is extracted, the package of the IC card 8 does not wear due to the contact between the contact portions 12*a* of the connector and portions near the electrode terminals 9 of the IC card 8.

In the above-described embodiment, the hooked holes 15*b* and the elongated holes 15*c* are disposed in upper positions and lower positions, respectively, in both side walls of the moving frame 15. However, the hooked holes 15*b* and the elongated holes 15*c* may alternatively be reversed, i.e., disposed in lower positions and upper positions, respectively.

In addition, the above-described embodiment concerns a case in which the IC card 8 is inserted from above into the moving frame 15 so as to be operated in an upright state, but the present invention is not limited to this case, and the fixed frame 11 can be provided for use in a horizontal or inclined state, or a reversed vertical state which is reverse to the state shown in FIG. 1.

Figure 4:
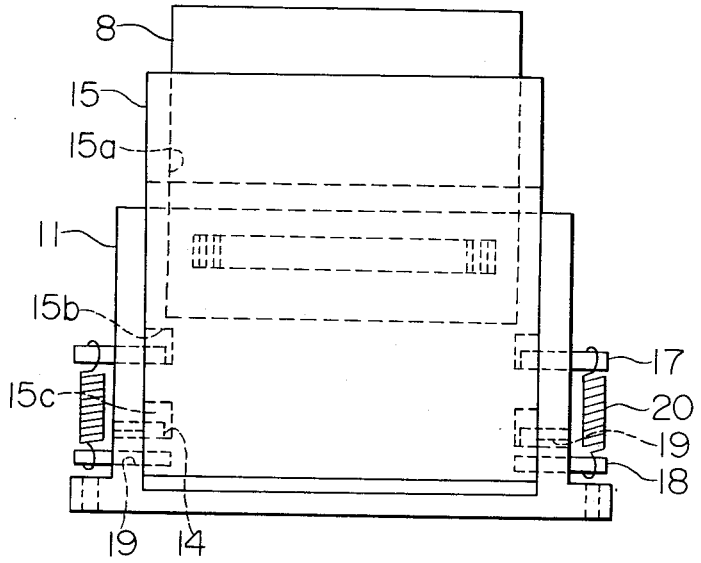
FIG. 4 is a front view of another embodiment.
Figure 5:
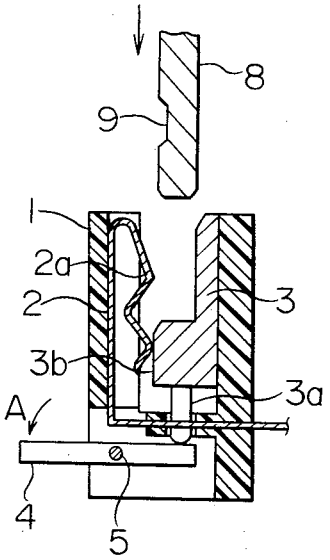
FIG. 5 PRIOR ART
FIGS. 5 and 6 are sectional side views of a conventional IC card connector in a state wherein the contact is opened and closed, respectively.
Figure 6:
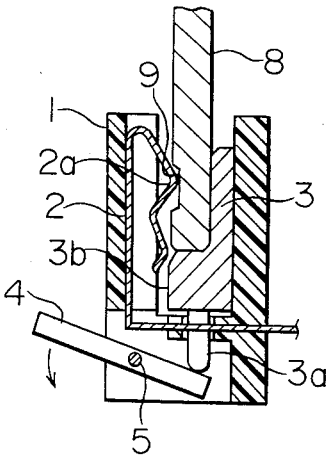
FIG. 6 PRIOR ART

FIG. 4 shows another embodiment of the present invention. This embodiment employs first support pins 17 which extend inward and outward from the fixed frame 11 in place of the first support pins 13 and which are also used as spring pegs. In addition, retainer pins 18 are fixed to lower positions in both side walls of the moving frame 15 and have one end each passing through elongated holes 19 which are provided in the sides of the fixed frame 11 and extending outward therefrom. Tension springs 20 are provided between the support pins 17 and the retainer pins 18 outside of the fixed frame 11 in place of the compression springs 16 of the embodiment shown in FIG. 1, these springs acting to push the moving frame 15 upwardly.

In addition, in each of the above-described embodiments, the engagement of the hooked holes 15*b* and the elongated holes 15*c* with the first support pins 13 or 17 and the second support pins 14, respectively, provides a mechanism having a means for rotatably supporting the moving frame 15 as well as a means for holding the moving frame 15 at the first position, but the present invention is not limited to this mechanism. The moving frame 15 may be rotated by other appropriate means than the engagement between the support pins and the engagement holes. Also, the means for rotatably supporting the moving frame 15 and the means for holding it at the first position may be separately provided independent of each other.

Although the fixed frame 11 is made of an insulating material for the purpose of preventing short circuiting of a plurality of the electrode pieces 12, a conductor such as a metal can be used for the fixed frame 11 if each of the electrode pieces is provided on the fixed frame in an electrically insulated state. Further, if the moving frame 15 is provided in such a manner that it is not brought into contact with either the electrode terminals 9 of the IC card 8 or the electrode pieces 12 of the fixed frame 11, it can also be made of a conductor such as a metal.

As described above, the present invention provides the contact between the electrode terminals of the IC card and the contact portions of the electrode pieces of the connector by rotating the moving frame in which the IC card is inserted into the holding portion. Therefore, a contact can be obtained with high reliability regardless of the thickness of the IC card and the elastic forces of the electrode pieces.

In addition, since the IC card can be extracted from and inserted into the connector in a state wherein the connector moving frame is disposed at a certain angle with respect to the connector fixed frame, the package of the IC card does not wear while during repeated extraction and insertion thereof.

What is claimed is:

1. An IC card connector capable of holding an IC card and providing electrical contact with each of the electrode terminals of said IC card, said connector comprising:

a fixed frame;

electrode pieces which are attached to said fixed frame and have ends extending in said fixed frame to form contact portions;

a moving frame having a holding portion in which an IC card can be inserted and held and a window through which said electrode terminals of said IC card are exposed for contact with said electrode pieces when said IC card is inserted into said holding portion; and support means for supporting said moving frame on said fixed frame so that said moving frame can be rotated between a first position, at which each of said electrode terminals of said IC card inserted into said holding portion of said moving frame is brought into contact with a corresponding one of said contact portions of said electrode pieces through said window, and a second position, at which the contact between each of said electrode terminals of said IC card and a corresponding one of said contact portions of said electrode pieces is broken by rotating said moving frame to a position, which is at a certain angle with respect to said fixed frame, said support means being operable to hold said moving frame at said first position when said moving frame is rotated to take said first position.

2. An IC card connector according to claim 1 wherein said support means comprises first and second support pins which o are secured to said fixed frame parallel to each other, an elongated hole engaging said second support pin, and a hooked hole engaging said first support pin.

3. An IC card connector according to claim 2 wherein said first and second support pins are provided in opposing sides of said fixed frame, and said elongated hole and said hooked hole are provided in opposing sides of said moving frame.

4. An IC card connector according to claim 2 wherein said hooked hole has a lateral portion which engages said first support pin to permit rotation of said moving frame when said moving frame is located at said second position, and a vertical portion which engages said first support pin to inhibit rotation of said moving frame when said moving frame is located at said first position.

5. An IC card connector according to claim 4 wherein said moving frame is urged by spring means in such a manner that said vertical portion of said hooked hole engages said first support pin when said moving frame is rotated to take said first position.

6. An IC card connector according to claim 5 wherein said spring means is held between the bottom of said fixed frame and the lower end of said moving frame.

7. An IC card connector according to claim 5 wherein said first support pins engaging said hooked holes extend outward from said fixed frame, and the sides of said moving frame are provided with retainer pins passing through the sides of said fixed frame and extending outward therefrom, said spring means being provided between said support pins and said retainer pins along the outside of said fixed frame.

8. An IC card connector according to claim 1 wherein said fixed frame is made of an insulator.

9. An IC card connector according to claim 1 wherein said moving frame is made of an insulator.

10. An IC card connector according to claim 1 wherein said electrode pieces are electrically insulated from said fixed frame.

11. An IC card connector according to claim 1 wherein said contact portions of said electrode pieces are formed by bending ends of said electrode pieces to form angular portions.

* * * * *